United States Patent [19]

Voross

[11] 4,074,183

[45] Feb. 14, 1978

[54] APPARATUS FOR MEASURING THE DWELL OF AN AUTOMOTIVE IGNITION SYSTEM

[75] Inventor: Zoltan Voross, Chicago, Ill.

[73] Assignee: Sun Electric Corporation, Chicago, Ill.

[21] Appl. No.: 672,484

[22] Filed: Mar. 31, 1976

Related U.S. Application Data

[63] Continuation of Ser. No. 587,520, June 16, 1975, abandoned.

[51] Int. Cl.[2] ..... F02P 17/00

[52] U.S. Cl. ..... 324/16 R

[58] Field of Search ..... 324/16 R, 16 T, 15

[56] References Cited

U.S. PATENT DOCUMENTS

| | | | |
|---|---|---|---|
| B 495,331 | 3/1976 | Johnston et al. | 324/16 R |
| 3,870,947 | 3/1975 | Fields | 324/16 R |
| 3,921,062 | 11/1975 | Kuhn et al. | 324/16 R |
| 3,984,760 | 10/1976 | Maringer | 324/16 T |

*Primary Examiner*—Stanley T. Krawczewicz

*Attorney, Agent, or Firm*—Allegretti, Newitt, Witcoff & McAndrews

[57] ABSTRACT

An apparatus for measuring the dwell of an automobile ignition system is disclosed. The dwell measuring apparatus is applicable to conventional and solid state ignition systems. The apparatus analyzes the primary coil ignition waveform and generates a signal proportional to the dwell ratio, based upon the amount of time the primary voltage is approximately zero.

19 Claims, 3 Drawing Figures

APPARATUS FOR MEASURING THE DWELL OF AN AUTOMOTIVE IGNITION SYSTEM

This is a continuation of application Ser. No. 587,520, filed June 16, 1975, now abandoned.

BACKGROUND OF THE INVENTION

The present invention relates generally to an ignition waveform analyzer and more particularly to an apparatus for measuring the dwell or dwell ratio of an automotive ignition system.

In an internal combustion engine, the spark plugs are fired by alternately connecting and disconnecting one end of the primary ignition coil and ground. The switching device, in a conventional ignition system, is an electromechanical circuit breaker or switch, commonly referred to as the "points". In an electronic ignition system, switching is performed by a solid state device, controlled by the points. The solid state switch, generally a power transistor, operates in a partial conduction mode to enhance engine performance.

As a result of this partial conduction capability, the primary coil voltage in an electronic ignition system varies from zero volts during the dwell period, in contrast to the conventional ignition system. In the presently known automotive test equipment, however, measurement of the dwell angle depends upon a zero or near zero volt primary signal. Thus, the presently available equipment is often incapable of accurately measuring the dwell angle of a solid state ignition system.

Various attempts have been made to design a voltage discriminator, which classifies primary coil voltages within a predetermined zone or window as "zero volts". Unfortunately, problems are immediately encountered. If the discrimination level is too low, then the dwell time, especially at low speeds, is inaccurately short, as the primary coil voltage increases towards the end of the dwell section. Conversely, if the discrimination level is too high, then the ringing portion of the primary waveform, particularly at high speeds, will interfere with proper dwell measurements.

SUMMARY OF THE INVENTION

In a principal aspect, the present invention is a dwell measuring apparatus. The apparatus includes a voltage generator for generating a voltage proportional in amplitude to the period of time wherein the primary ignition voltage is within a predetermined proximity of zero volts, a voltage comparator, having a two state, high-low output, responsive to the primary ignition signal and generated voltage, and a signal modifier responsive to the voltage comparator for generating a signal proportional to the dwell ratio of the ignition system under scrutiny.

It is thus an object of the present invention to provide an apparatus for measuring the dwell or dwell ratio of an automotive ignition system.

It is a further object of the present invention to provide a dwell measuring apparatus applicable to conventional and solid state or electronic ignition systems.

It is also an object of the present invention to provide a dwell measurement apparatus for solid state ignition systems wherein the difficulties resulting from the partial conduction capability of the ignition system are substantially avoided.

It is another object of the present invention to provide an accurate, reliable, and readily manufactured dwell measurement apparatus.

These and other objects, features and advantages of the present invention become apparent in the following detailed description.

BRIEF DESCRIPTION OF THE DRAWING

A preferred embodiment of the present invention will be described, in detail, with reference to the drawing wherein.

DETAILED DESCRIPTION OF A PREFERRED EMBODIMENT

Figure 1:
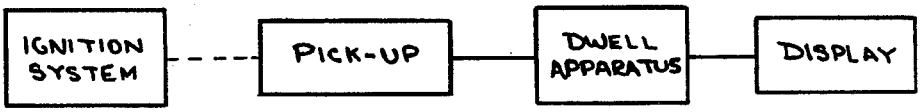
FIG. 1 is a block diagram illustrating a preferred embodiment of the present invention.

Referring to FIG. 1, a preferred embodiment of the present invention is shown as an apparatus 10 for measuring the dwell or dwell ratio of an automobile ignition system 12. The apparatus 10 receives the primary ignition coil waveform, shown in FIG. 3, as an input signal via a pick-up 14 electromechanically coupled to the ignition system 12. The output of the dwell measurement apparatus 10, in this preferred embodiment, is coupled to a display 16 for analysis. As previously indicated, the dwell measurement apparatus 10 is equally applicable to conventional or electromechanical and solid state or electronic ignition systems.

Figure 2:
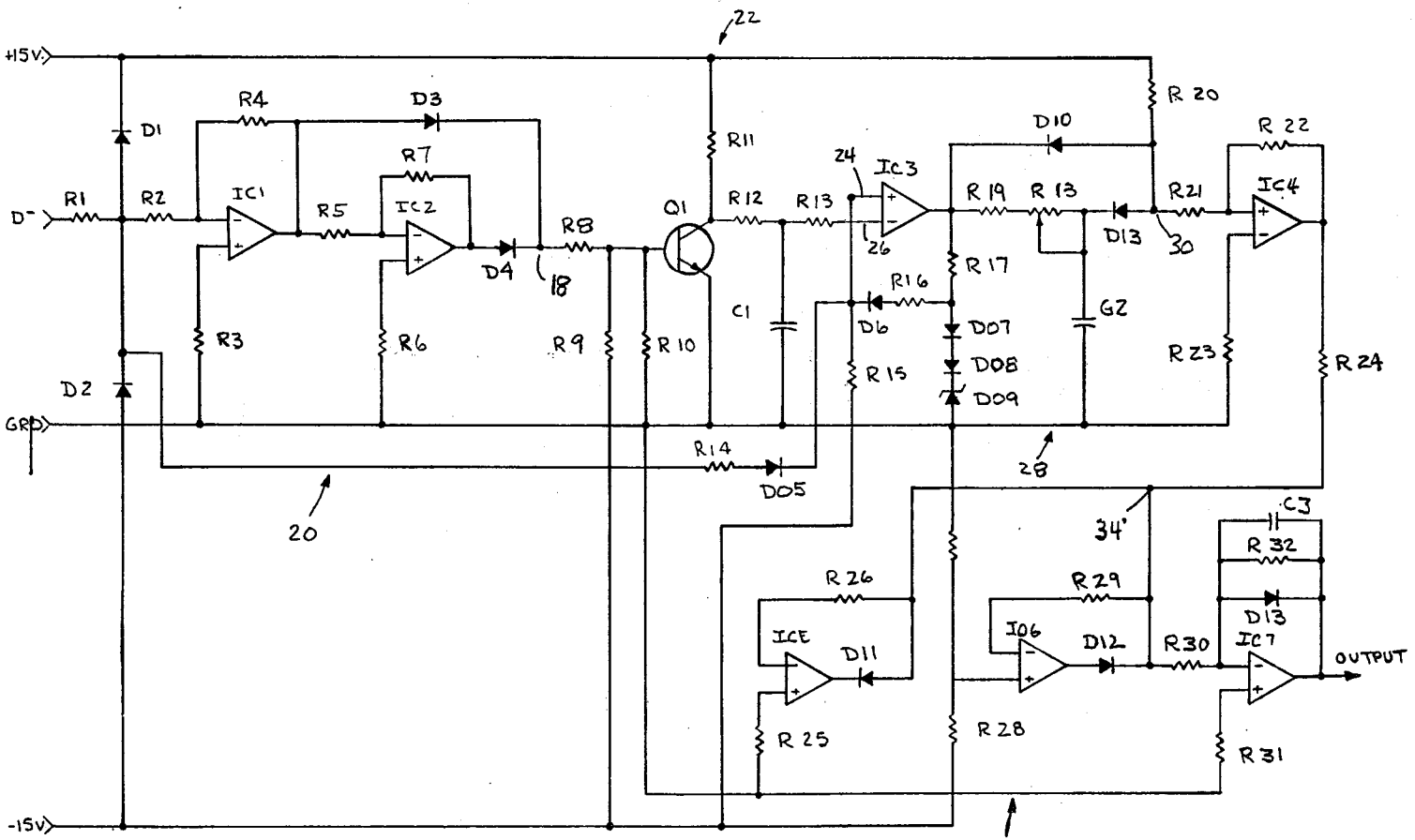
FIG. 2 is a schematic diagram of the preferred embodiment shown in FIG. 1.

Referring now to FIG. 2, the dwell measurement circuit 10 includes resistors R1–R32, capacitors C1–C3, diodes D1–D14, integrated circuits IC1–IC7 and transistor Q1, interconnected as shown. The dwell measurement apparatus 10 also includes two biasing potentials, references ± 15V, and an input terminal D7 for receiving the primary ignition coil waveform.

The integrated circuits IC1, IC2 are inverting amplifiers. Thus, a positive voltage is coupled to the junction or node 18 through either the diode D3, or D4. More particularly, if the primary coil voltage is positive, the output of integrated circuit IC2 is positive; if the voltage at the input terminal D7 is negative, then the output of the integrated circuit IC1 is positive. As such, the integrated circuits IC1, IC2 and diodes D3, D4 cooperatively define conversion means, generally designated 20, for producing a modified primary coil signal, representing the absolute value of the actual primary coil voltage. The amplifier IC1 also limits or "clips" voltage at the junction 18.

The converted voltage is coupled to the gate terminal of the transistor Q1, a controllably conductive semiconductor device. With sufficiently positive bias, the transistor Q1 conducts and the capacitor C1 rapidly discharges through the low resistance of the resistor R12. When the transistor Q1 is "OFF", i.e., when the positive voltage couples through the diodes D3, D4 is insufficient to overcome the negative biasing effect of the resistor R9, the capacitor C1 charges, slowly with respect to the discharge rate, through the high series resistance of the resistors R11, R12 towards +15 volts.

Figure 3:
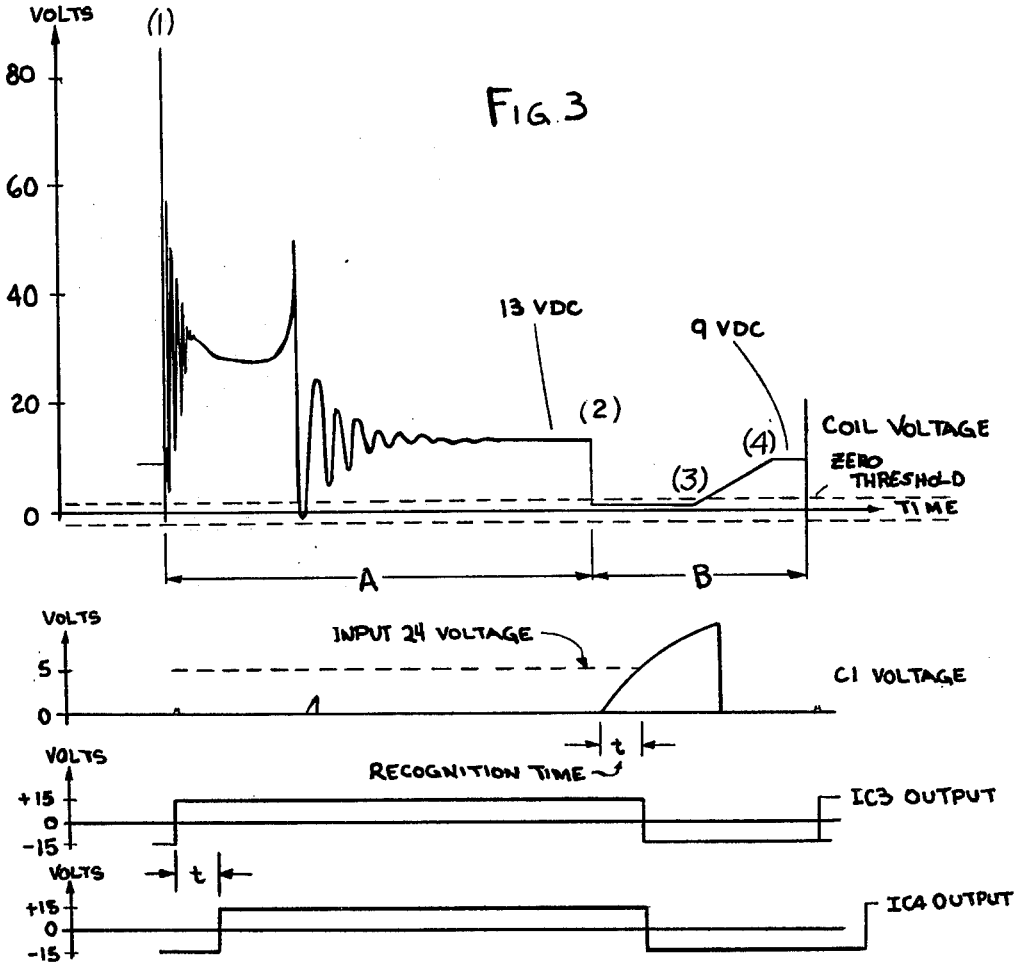
FIG. 3 is a graph or plot of the waveforms analyzed in or generated by the preferred embodiment shown in FIG. 1.

The transistor Q1, power supply and associated resistors define, in combination, means, generally designated 22, for charging and discharging the capacitor C1. That is, the transistor Q1 has a conductive voltage threshold or, more particularly, a required gate voltage for conduction. This conduction voltage threshold is shown in FIG. 3. Excursions of the primary waveform below the voltage threshold cause the transistor Q1 to turn "OFF".

The integrated circuit IC3 is a voltage comparator having a positive input terminal 24 and negative input terminal 26. As shown, the capacitor C1 is coupled to the negative input terminal 26. The integrated circuit IC3 has a two state, high-low output. If the voltage of the terminal 24 is greater, the integrated circuit IC3 is saturated and the output is a +15 volt signal. Conversely, if the voltage on the input terminal 26 is greater, the output of the integrated circuit IC3 is a −15 volts.

The diodes D7, D8, D9 form a zener diode fed by the resistor R17. In the high state, the voltage on the input terminal 24 is established by the zener voltage and voltage divider factor of the resistors R15, R16 and diode D6. In this preferred embodiment, the positive input voltage to the comparator IC3 is, in the high state, preferably five volts, as shown in FIG. 3.

When the dwell section of the ignition cycle begins, referenced (2) in FIG. 3, the capacitor C1 charges exponentially towards the +15 volt supply. As the voltage on the capacitor C1 and input terminal 26 equal or slightly exceed the 5 volt comparison voltage on the input terminal 24, the comparator IC3 switches to a low state, generating a −15 output signal. As such, the input 24 assumes a voltage determined by the primary ignition signal at the input terminal D7, appropriately divided by the resistors R1, R14, R15 and diode D5. More particularly, the voltage on the input terminal 24 of the comparator IC3 becomes negative upon transition or switching to the low state.

Referring to FIG. 3 and particularly reference point (3), the primary ignition signal begins to rise after a portion of the dwell section. In response, the transistor Q1 conducts and the capacitor C1 discharges to zero volts through the main terminals of the transistor Q1. Due to the negative voltage on the input terminal 24, the integrated circuit IC3 remains in the low state.

At the end of the dwell section or spark plug fire, referenced (1), the primary waveform and thus the voltage on the input 24 go rapidly positive and the comparator IC3 switches or returns to the high or positive output state. As shown in FIG. 3, the comparator IC3 switches to the positive output state immediately at the end of the dwell period. Switching to the negative state takes place only after a delay time "*t*", wherein the capacitor C1 charges from zero volts to the positive comparison voltage on the input 24 of the comparator IC3.

The integrated circuit IC4 is a zero level or state transition detector. The comparator IC3 is interconnected to the integrated circuit IC4 by coupling means, generally designated 28. The input to the integrated circuit IC4 is junction or node 30.

When the integrated circuit IC3 switches from a positive or high state to a negative or low state, the junction or input 30 is clamped to the output of the integrated circuit IC3 by the diode D10. As a result, the output of the integrated circuit IC4 switches to a negative or low state, without delay. Under these conditions, the capacitor C2 charges to approximately −15 volts.

As switching of the integrated circuit IC3 from a negative state to a positive state occurs, the input 30 is held by the diode D13 to the voltage on the capacitor C2. The variable resistor R18 is adjusted such that the zero detector IC4 switches or returns to its positive state time "*t*" after the integrated circuit IC3 has switched or returned to its positive state. That is, the capacitor C2 charges at a rate that delays the switching of the zero detector IC4, in response to the integrated circuit IC3, by the time "*t*".

Referring to FIG. 3, the output of the integrated circuit IC4 is low for time "*t*" after the beginning of the dwell section and high for time "*t*" after the end of the dwell section. Thus, the output of the integrated circuit IC4 is a square wave having an on/off ratio equal to the dwell ration B/A of the primary signal waveform.

The remaining circuitry cooperatively defines output means, generally designated 32. The integrated circuits IC5, IC6, IC7 are a top clipper, bottom clipper, and integrator, respectively. When the output of the integrated circuit IC4 is positively saturated, the top clipper IC5 prevents the voltage at the node 34 from exceeding zero volts. The bottom clipper IC6 is inactive during this time period. When the output of the integrated circuit IC4 is negatively saturated, the bottom clipper IC6 substantially clamps the junction 24 to −5 volts. The function of the clippers IC5, IC6 is to provide precise voltage levels at the input of the integrator IC7. The integrator IC7 filters and converts the negative pulse train in such a manner that its output coupled to the display 16, is proportional to the dwell ratio B/A.

A single preferred embodiment of the present invention has been described and disclosed herein. It is to be understood, however, that various modifications and changes can be made without departing from the true scope and spirit of the present invention, as defined in the following claims.

What is claimed is:

1. An apparatus for measuring the dwell of an ignition system having a primary ignition signal comprising, in combination:

input means for receiving said primary ignition signal;

conversion means for producing a modified primary ignition signal, representing the absolute value of said primary ignition signal;

storage means for storing a voltage;

controllably conductive means operable in a first state and a second state in response to said modified primary ignition signal, said controllably conductive means charging said storage means in said first state and discharging said storage means in said second state, said controllably conductive means defining a voltage threshold, said controllably conductive means being operable in said first state whenever said voltage threshold exceeds said modified primary ignition signal, said controllably conductive means being operable in said second state whenever said second modified primary ignition signal exceeds said voltage threshold;

comparator means for comparing said voltage to a comparison voltage, said comparator means being operable in a first comparator state whenever said comparison voltage exceeds said voltage to produce a first output signal, said comparator means being operable in a comparator second state whenever said voltage exceeds said comparison voltage to produce a second output signal;

means for setting said comparison voltage in response to said first output signal of said comparator means and said primary ignition signal, said comparison voltage being a positive voltage substantially throughout said first comparator state and a negative voltage substantially throughout said second comparator state;

detector means for detecting a voltage crossing between said first output signal and said second output signal of said comparator means; and means for coupling said comparator means and said detector means, said coupling means including means for delaying transmission of said second output signal to said detector means whenever said comparator means switches from said first comparator state to said second comparator state, said detector means generating a signal in response to said comparator means representing said dwell of said ignition system.

2. An apparatus as claimed in claim 1 wherein said conversion means includes a first and second voltage inverter.

3. An apparatus as claimed in claim 2 wherein said conversion means further includes a first and second diode coupling said first and second inverter, respectively, to said controllably conductive means.

4. An apparatus as claimed in claim 1 wherein said storage means includes a capacitor.

5. An apparatus as claimed in claim 4 wherein said controllably conductive means connects said capacitor to ground during said second state.

6. An apparatus as claimed in claim 1 wherein said controllably conductive means includes a transistor having a pair of main terminals and a control terminal.

7. An apparatus as claimed in claim 6 wherein said storage means includes a capacitor coupled to said main terminals of said transistor.

8. An apparatus as claimed in claim 6 wherein said conversion means is coupled to said control terminal.

9. An apparatus as claimed in claim 1 wherein said detector means has an input and an input voltage.

10. An apparatus as claimed in claim 9 wherein said delaying means includes means for clamping said comparator means and said input whenever said comparator means is in said second comparator state.

11. An apparatus as claimed in claim 10 wherein said delaying means further includes means for variably maintaining said input voltage for a predetermined time whenever said comparator means switches to said first comparator state.

12. An apparatus for measuring the dwell of an ignition system producing a primary ignition signal, said primary ignition signal having peak and a dwell period, comprising, in combination:

storage means for storing a voltage;

controllably conductive means, operable in a first state and a second state, for charging said storage means in said first state and discharging said storage means in said second state, said controllably conductive means defining a voltage threshold, said controllably conductive means being responsive to said primary ignition signal and operable in said first state whenever said primary ignition signal is substantially within said voltage threshold or 0 volts;

comparator means for comparing said voltage to a comparison voltage, said comparator means being operable in a first comparator state to produce a first output signal and operable in a second comparator state to produce a second output signal;

means for setting said comparison voltage in said first and second comparator states, whereby said comparator means switches to said first comparator state a predetermined time after initiation of said dwell period and switches to said second comparator state in response to said peak;

detector means for detecting a voltage crossing between said first output signal and said second output signal of said comparator means, said detector means producing an output signal in response to said voltage crossings; and delay means for delaying transmission of said second output signal to said detector means for substantially said predetermined time whenever said comparator means switches from said first comparator state to said second comparator state.

13. An apparatus as claimed in claim 12 wherein said storage means includes a capacitor.

14. An apparatus as claimed in claim 12 wherein said controllably conductive means includes a transistor having a pair of main terminals and a control terminal.

15. An apparatus as claimed in claim 4 wherein said storage means includes a capacitor coupled to said main terminals of said transistor.

16. An apparatus as claimed in claim 12 wherein said detector means has an input and an input voltage.

17. An apparatus as claimed in claim 16 wherein said delay means includes means for clamping said comparator means and said input whenever said comparator means is in said second comparator state.

18. An apparatus as claimed in claim 17 wherein said delay means further includes means for variably maintaining said input voltage whenever said comparator means switches to said first comparator state.

19. An apparatus as claimed in claim 12 further comprising output means for visually displaying said output signal.

* * * * *